US006255258B1

(12) United States Patent
Clark et al.

(10) Patent No.: US 6,255,258 B1
(45) Date of Patent: Jul. 3, 2001

(54) DISPERSANT ADDITIVE

(75) Inventors: Michael T. Clark, Oxford; Graham A. Warren, Liverpool, both of (GB)

(73) Assignee: Infineum USA L.P., Linden, NJ (US)

( * ) Notice: Subject to any disclaimer, the term of this patent is extended or adjusted under 35 U.S.C. 154(b) by 0 days.

(21) Appl. No.: 09/432,740

(22) Filed: Nov. 2, 1999

(30) Foreign Application Priority Data

Nov. 4, 1998 (EP) ..... 98309024

(51) Int. Cl.[7] ..... C10M 133/16; C10M 133/56; C07D 207/412

(52) U.S. Cl. ..... 508/232; 508/288; 508/291; 548/546

(58) Field of Search ..... 508/232, 288, 508/291; 548/546

(56) References Cited

U.S. PATENT DOCUMENTS 4,208,190 6/1980 Malec ..... 44/53
4,548,724 * 10/1985 Karol et al. .
4,747,964 5/1988 Durand et al. ..... 252/51.5 A
4,973,412 * 11/1990 Migdal et al. .
5,062,980 * 11/1991 Migdal et al. .
5,112,507 * 5/1992 Harrison .
5,230,817 * 7/1993 Lundberg et al. .
5,256,325 * 10/1993 Emert et al. .
5,464,549 * 11/1995 Sieberth .
5,880,070 * 3/1999 Harrison et al. .

FOREIGN PATENT DOCUMENTS 0 331 397 A2 9/1989 (EP) ..... C10M/159/12
2 231 873 11/1990 (GB) ..... C10M/107/22

* cited by examiner

*Primary Examiner*—Jerry D. Johnson

(57) ABSTRACT

An oil-soluble dispersant obtainable by reacting the reaction product of a polyamine and a long-chain hydrocarbyl-substituted dicarboxylic acid, anhydride or ester thereof with a polyanhydride, characterized in that the dispersant restricts the viscosity increase in an oil to below 8 Pa.s in the Haake rheology test defined herein at 2% w/w active matter and a shear rate of 0.26 $s^{-1}$ Pa.s, and lubricating oil and fuel compositions and additive concentrates containing such a dispersant.

10 Claims, No Drawings

DISPERSANT ADDITIVE

FIELD OF THE INVENTION

This invention relates to dispersant additives for use in lubricating oil and fuel compositions.

BACKGROUND OF THE INVENTION

Multigrade lubricating oils must operate in the presence of high levels of sludge and soot resulting from oxidation during use. This accumulation of sludge and soot can seriously impair the efficiency of the oil and can result in damage to components of an engine.

To avoid these problems the multigrade lubricating oils may be formulated with dispersant additives. Various organo-metallic additives have been used previously as dispersants, but it has been recognised that the use of these dispersants may result in the deposit of metal oxides on spark plugs and so may affect engine ignition.

In addition to dispersant additives, a typical multigrade oil may also comprise viscosity index (VI) improvers. These additives are intended to produce a balance between the maximum low and high temperature viscosities. Examples of such additives are disclosed in EP-A-0331397. The additives are described as nitrogen or ester-containing adducts which are post-reacted with at least one polyanhydride. The polyanhydride couples two or more molecules of the adduct, resulting in larger polymers which are more shear-sensitive and which contribute to the high temperature viscosity to a greater extent than the low temperature viscosity when compared to additives which have not undergone post-reaction.

The additives disclosed in EP-A-0331397 are claimed to improve the viscosity characteristics in an oil, and are intended to provide a balance in the low and high temperature viscosities of the oil. The dispersancy characteristics of the additives are not investigated. What is also clear is that the additives are formed by post-reactions with relatively high levels of polyanhydride, and that this is necessary to produce highly cross-linked molecules.

Similar additives to those disclosed in EP-A-0331397 are disclosed in U.S. Pat. No. 4,747,964, where the additives are tested for their dispersancy characteristics. However, the amount of polyanhydride used to produce the additives is again relatively high, being on average 3.6% w/w.

SUMMARY OF THE INVENTION

In accordance with the present invention there is provided an oil-soluble dispersant obtainable by reacting the reaction product of a polyamine and a long-chain hydrocarbyl-substituted dicarboxylic acid, anhydride or ester thereof with a polyanhydride, characterised in that the dispersant restricts the viscosity increase in an oil to below 8 Pa.s in the Haake rheology test defined herein at 2% w/w active matter and a shear rate of 0.26 $s^{-1}$ Pa.s.

DESCRIPTION OF THE INVENTION

Dispersants of the present invention are obtainable by reacting the hydrocarbyl-polyamine product with a suitable amount of polyanhydride. The hydrocarbyl-substituted dicarboxylic acid materials are well known in the art, e.g. as described in EP-A-0331397. Preferably, the long-chain hydrocarbon group is a polymer of a $C_2$ to $C_{18}$, e.g. $C_2$ to $C_5$, monoolefin with a molecular weight of between 700 to 5000. Suitable olefins include ethylene, propylene, butylene, isobutylene, etc. Preferred polyolefins are polyisobutylene and atactic polypropylene. The molar ratio of dicarboxylic acid, ester or anhydride: polyolefin is typically from 1:1 to 2:1. Examples of long-chain hydrocarbyl-substituted dicarboxylic acids, anhydrides and esters, include substituted succinic acid and succinic anhydride.

The polyamine compounds useful in the invention are preferably of the formula (I):

$$H_2N—(CHR')_x—CH_2—[A—CH_2—(CHR')_x]_y—NH_2 \quad (I)$$

where A is NH or O; each R' is H or methyl; x is 1–6; and y is 1–10 when A is NH, or 1–200 when A is O.

Examples of suitable polyamines include tetraethylene pentamine and polypropylene amines.

The polyanhydrides that are used in the present invention are known in the prior art and include pyromellitic dianhydride (PMDA), cyclohexyl dianhydride and 3,3',4,4'-benzophenonetetracarboxylic dianhydride.

Typically, the long-chain hydrocarbyl-substituted dicarboxylic acid, anhydride or ester will be reacted with a suitable polyamine at a molar ratio of 1:1 to 2:1.

The hydrocarbyl-polyamine product will in general be reacted with less than 6% w/w, preferably less than 3% w/w, and more preferably less than 2% w/w, polyanhydride.

The important feature is that the level of polyanhydride is such that the resultant dispersant restricts the viscosity increase in an oil.

The measurement of the viscosity increase is carried out using the Haake rheology test. This test comprises adding a known concentration (e.g. 2% w/w) of the dispersant under test to a mixture of other compounds, to produce a fully formulated oil. Carbon black (a soot "mimic") is then added to the oil and mixed at an elevated temperature for a set period of time. The viscometric characteristics of the oil are then measured and compared with a standard dispersant under the same conditions.

The base oil blend used in the Haake rheology test consists of the following components:

| Component | Concentration % w/w |
|---|---|
| Detergents (overbased calcium and magnesium alkyl salicylates) | 3.5 |
| Anti-wear additive (zinc dithiophosphate (ZDTP)) | 1.13 |
| Viscosity index improver (hydrogenated polyisoprene) | 5.88 |
| Pour point depressent (polymethyacrylate) | 0.34 |
| Mixture of base oils | 89.15 |

The Haake rheology test apparatus comprises a Haake RV 20 rheometer with RC 20 rheocontroller and CV 100 measuring system with a ZA 30 cup and rotor.

The samples are prepared by weighing (100/active matter) g of the dispersant sample, made up to 5.75 g with HVI-60-AL base oil, and then 50 g total mass with the base oil blend.

The carbon black (grade XC72) is activated at 140° C. for at least 12 hours prior to use in the rheology test. An amount, 0.25 to 0.30 g, of the carbon black is measured, and fully formulated oil is added in an amount as calculated by the formula:

$$M_{FFO}=M_c\times 20$$

where $M_{FFO}$ is the mass of the fully formulated oil (g), and $M_c$ is the mass of carbon black (g). The mixture is completely homogenised with the oil. The viscosity characteristics are then measured over a range of shear rates for 30 minutes. Viscosities measured at a shear rate of 0.26 $s^{-1}$ are quoted in Tables 1, 2 and 3.

As discussed above, the dispersant of the present invention may be used in lubricating oils. Accordingly, the present invention provides a lubricating oil composition comprising a major amount (more than 50%w) of a lubricating base oil and a minor amount (less than 50%w), preferably from 0.1 to 20%w, especially from 0.5 to 10%w (active matter), of a dispersant according to the present invention, the percentages by weight being based on the total weight of the composition.

A lubricant formulation may be produced by addition of an additive package to the lubricating oil. A minor amount of viscosity modifier may be included if the final lubricant formulation is to be a multigrade version. The type and amount of additive package used in the formulation depends on the final application, which can include spark-ignition and compression-ignition internal combustion engines, including automobile and truck engines, marine and railroad diesel engines, gas engines, stationary power engines and turbines.

The lubricant formulation is blended to meet a series of performance specifications as classified in the US by a tripartite arrangement between the Society of Automotive Engineers (SAE), American Petroleum Institute (API) and American Society for Testing and Materials (ASTM). Also the American Automobile Manufacturers Association (AAMA) and Japan Automobile Manufacturers Association Inc. (JAMA), via an organisation called the International Lubricant Standardisation and Approval Committee (ILSAC), jointly develop minimum performance standards for gasoline-fuelled passenger car engine oils.

In Europe, engine oil classifications are set by the Association des Constructeurs Europeens de l'Automobile (ACEA) in consultation with the Technical Committee of Petroleum Additive Manufacturers (ATC) and Association Technique de l'Industries Europeens des Lubrifants (ATIEL). Besides these internationally recognised oil classification systems, many, if not all, Original Equipment Manufacturers (OEMs) have their own in-house performance requirements that must be met by lubricant formulations used for first (i.e. factory) fill.

Suitable lubricating base oils are natural, mineral or synthetic lubricating oils.

Natural lubricating oils include animal and vegetable oils, such as castor oil. Mineral oils comprise the lubricating oil fractions derived from crude oils, e.g. of the naphthenic or paraffinic types or mixtures thereof, coal or shale, which fractions may have been subjected to certain treatments such as clay-acid, solvent or hydrogenation treatments. Synthetic lubricating oils include synthetic polymers of hydrocarbons, e.g. derived from polyalphaolefins, isomerised slack wax, modified alkylene oxide polymers and esters, which are known in the art. These lubricating oils are preferably crankcase lubricating oil formulations for spark-ignition and compression-ignition engines, but include also hydraulic lubricants, metal-working fluids and automatic transmission fluids.

Preferably the lubricating base oil component of the compositions according to the present invention is a mineral lubricating oil or a mixture of mineral lubricating oils, such as those sold by member companies of the Royal Dutch/Shell Group of Companies under the designations "HVI", or the synthetic hydrocarbon base oils sold by member companies of the Royal Dutch/Shell Group of Companies under the designation "XHVI" (trade mark).

The viscosity of the lubricating base oils present in the compositions according to the present invention may vary within wide ranges, and is generally from 3 to 35 $mm^2/s$ at 100° C.

The lubricating oil compositions according to the resent invention may contain various other additives known in the art, such as:

(a) Viscosity index improvers or modifiers. The viscosity modifier may be of the solid type or a concentrate in a natural or synthetic base stock and can be defined as a substance, usually a polymer, which substantially improves (e.g. by at least 5 units) the viscosity index (e.g. as determined by ASTM procedure D2270) by its incorporation. These can all be incorporated into the final lubricant formulation to give the desired performance properties thereof. Examples of such viscosity modifiers are linear or star-shaped polymers of a diene such as isoprene or butadiene, or a copolymer of such a diene with optionally substituted styrene. These copolymers are suitably block copolymers and are preferably hydrogenated to such an extent as to saturate most of the olefinic unsaturation. A number of other types of viscosity modifier are known in the art, and many of these are described in Proceedings of Conference "Viscosity and flow properties of multigrade engine oils", Esslingen, Germany, December 1977. It is also known in the art that viscosity modifiers can be functionalised to incorporate dispersancy (e.g. dispersant viscosity index improvers based on block copolymers, or polymethacrylates) and/or antioxidant functionality as well as viscosity modification and they can also have pour point depressants mixed in to give handleable products in cold climates.

(b) Ashless or ash-containing extreme pressure/anti-wear additives, such as, for example, those of the metal containing dithiophosphate or ashless dithiocarbamate type, and mixtures thereof. The actual composition of the individual components will vary depending upon final application and hence can be based on a range of metal ion types and various alcohols, in which both alkyl and aryl moieties may be of varying size. Preferred are zinc dithiophosphates (ZDTPS) or sodium dithiophosphates.

(c) Dispersants including succinimides and Mannich bases, both of various molecular weights and amine type, including borated versions, or esters also of varying type and molecular weight. Preferred are ashless dispersants such as polyolefin-substituted succinimides, e.g. those described in GB-A-2231873.

(d) Anti-oxidants, for example of the aminic type such as "IRGANOX" (trade mark) L57 (tertiary $C_4$–$C_{12}$ alkyl diphenylamine) or phenolic type such as "IRGANOX" (trade mark) L135 (2,6-ditertiary-butyl-4-(2-carboxy (alkyl)ethyl)phenol) (ex. CIBA Speciality Chemicals) or a soluble copper compound at a copper concentration of between 50 and 500 ppm.

(e) Anti-rust compounds of, for example, the ethylene/propylene block copolymer type.

(f) Friction modifiers for fuel economy, either metal (e.g. molybdenum) containing, or metal free esters and amines, or synergistic mixtures thereof.

(g) Metal containing detergents such as phenates, sulphonates, salicylates or naphthenates, or mixtures thereof, all of which detergents may be either neutral or overbased, such overbased detergents being carbonates, hydroxides or mixtures thereof. The metals are preferably calcium, magnesium or manganese, although alkali metals such as sodium or potassium could also be used.

(h) Copper passivators, preferably of the alkylated or benzylated triazole type.

As discussed above, the dispersant of the present invention may also be used in fuels. Accordingly, the present invention further provides a fuel composition comprising a major amount (more than 50%w) of a base fuel and a minor amount (less than 50%w), preferably from 0.001 to 2%w, more preferably from 0.001 to 0.5%w and especially from 0.002 to 0.2%w (active matter), of a dispersant according to the present invention, the percentages by weight being based on the total weight of the composition.

Suitable base fuels include gasoline and diesel fuel. These base fuels may comprise mixtures of saturated, olefinic and aromatic hydrocarbons, and may contain a range of sulphur levels, e.g. in the range 0.001 to 0.1%w. They can be derived from straight-run gasoline, synthetically produced aromatic hydrocarbon mixtures, thermally catalytically cracked hydrocarbon feedstocks, hydrocracked petroleum fractions or catalytically reformed hydrocarbons.

The fuel compositions according to the present invention may contain various other additives known in the art, such as:

(a) Anti-knock additives, such as lead compounds, or other compounds such as methyl cyclopentadienyl-manganese tricarbonyl or orthoazidophenyl.

(b) Co-antiknock additives, such as benzoylacetone.

(c) Dehazers, such as those commercially available as "NALCO" (trade mark) EC5462A (ex. Nalco), "TOLAD" (trade mark) 2683 (ex. Baker Petrolite), EXP177, EXP159M, EXP175, EP409 or EP435 (ex. RE Speciality Chemicals), and T9360-K, T9305, T9308, T9311 or T327 (ex. Baker Petrolite).

(d) Anti-foaming agents, such as those commercially available as "TEGOPREN" (trade mark) 5851, Q 25907, MR1027, MR2068 or MR2057 (ex. Dow Corning), "RHODORSIL" (trade mark) (ex. Rhone Poulenc), and "WITCO" (trade mark) SAG TP325 or SAG327 (ex. Witco).

(e) Ignition improvers (e.g. 2-ethylhexyl nitrate, cyclohexyl nitrate, di-tertiary-butyl peroxide and those disclosed in U.S. Pat. No. 4,208,190 at Column 2, line 27 to Column 3, line 21)

(f) Anti-rust agents (e.g. that commercially sold by Rhein Chemie, Mannheim, Germany as "RC 4801", or polyhydric alcohol esters of a succinic acid derivative, the succinic acid derivative having on at least one of its alpha carbon atoms an unsubstituted or substituted aliphatic hydrocarbon group containing from 20 to 500 carbon atoms (e.g. the pentaerythritol diester of polyisobutylene-substituted succinic acid)

(g) Reodorants.

(h) Anti-wear additives.

(i) Anti-oxidants (e.g. phenolics such as 2,6-di-tert-butylphenol, or phenylenediamines such as N,N'-di-sec-butyl-p-phenylenediamine).

(j) Metal deactivators.

(k) Lubricity agents, such as those commercially available as EC831, "PARADYNE" (trade mark) 631 or 655 (ex. Paramins) or "VEKTRON" (trade mark) 6010 (ex. Shell Additives International Limited).

(l) Carrier fluids such as a polyether e.g. a $C_{12}$–$C_{15}$ alkyl-substituted propylene glycol ("SAP 949"), "HVI" or "XHVI" (trade mark) base oil, which are commercially available from member companies of the Royal Dutch/Shell Group of Companies, a polyolefin derived from $C_2$–$C_6$ monomers, e.g. polyisobutylene having from 20 to 175, particularly 35 to 150, carbon atoms, or a polyalphaolefin having a viscosity at 100° C. in the range $2\times10^{-6}$ to $2\times10^{-5}$ $m^2/s$ (2 to 20 centistokes), being a hydrogenated oligomer containing 18 to 80 carbon atoms derived from at least one alphaolefinic monomer containing from 8 to 18 carbon atoms.

The lubricating oil and fuel compositions of the present invention may be prepared by adding the dispersant of the present invention to a lubricating base oil or base fuel. Conveniently, an additive concentrate is blended with the lubricating base oil or base fuel. Such a concentrate generally comprises an inert carrier fluid and one or more additives in a concentrated form. Hence the present invention also provides an additive concentrate comprising an inert carrier fluid and from 10 to 80%w (active matter) of a dispersant according to the present invention, the percentages by weight being based on the total weight of the concentrate.

Examples of inert carrier fluids include hydrocarbons and mixtures of hydrocarbons with alcohols or ethers, such as methanol, ethanol, propanol, 2-butoxyethanol or methyl tert-butyl ether. For example, the carrier fluid may be an aromatic hydrocarbon solvent such as toluene, xylene, mixtures thereof or mixtures of toluene or xylene with an alcohol. Alternatively, the carrier fluid may be a mineral base oil or mixture of mineral base oils, such as those sold by member companies of the Royal Dutch/Shell Group of Companies under the designations "HVI", e.g. "HVI 60" base oil, or the synthetic hydrocarbon base oils sold by member companies of the Royal Dutch/Shell Group of Companies under the designation "XHVI" (trade mark).

Non-limiting examples of suitable additive concentrations in final blended lubricating oil compositions are:

| Oil component % mass | A | B | C | D | E | F |
|---|---|---|---|---|---|---|
| Alkaline earth sulphonate detergent | 3.8 | 3.4 | — | — | — | — |
| Alkaline earth phenate detergent | 1.2 | 1.1 | — | — | — | — |
| Alkaline earth salicylate detergent | — | — | 4.6 | 2.5 | 3.6 | 10.5 |
| High molecular weight dispersant | — | 5.5 | 8.0 | 5.0 | 11.5 | — |
| Low molecular weight dispersant | 6.0 | 2.0 | — | — | — | 9.0 |
| Primary ZDTP | 0.5 | — | — | 0.3 | — | 0.7 |
| Secondary ZDTP | 0.4 | 1.0 | 0.9 | 0.7 | 1.2 | 0.6 |
| Aminic antioxidant | — | — | 0.6 | 0.8 | 0.3 | — |
| Phenolic antioxidant | 0.7 | 1.2 | — | — | — | — |
| Base oil | balance | balance | balance | balance | balance | balance |

Non-limiting examples of suitable additive concentrates for blending lubricating oil compositions are:

| Oil component % mass | A | B | C | D | E | F |
|---|---|---|---|---|---|---|
| Alkaline earth sulphonate detergent | 29.9 | 23.8 | — | — | — | — |
| Alkaline earth phenate detergent | 9.4 | 7.7 | — | — | — | — |
| Alkaline earth salicylate detergent | — | — | 32.4 | 26.6 | 21.6 | 50.2 |
| High molecular weight dispersant | — | 38.5 | 56.3 | 53.2 | 68.9 | — |
| Low molecular weight dispersant | 47.2 | 14.0 | — | — | — | 43.1 |
| Primary ZDTP | 3.9 | — | — | 3.2 | — | 3.3 |
| Secondary ZDTP | 3.1 | 7.0 | 6.3 | 7.4 | 7.2 | 2.9 |
| Aminic antioxidant | — | — | 4.2 | 8.5 | 1.8 | — |
| Phenolic antioxidant | 5.5 | 8.4 | — | — | — | — |
| Base oil | balance | balance | balance | balance | balance | balance |

The following Examples illustrate the invention.

EXAMPLE 1

Preparation of HMW/PMDA Dispersant

A reaction vessel was charged with 200 g polyisobutenyl succinic anhydride (50% active matter in HVI-60 and an acid value of 0.4 mmol/g, comprising the reaction product of polyisobutene of Mn 2200 and maleic anhydride) and then heated to 160° C. under a nitrogen blanket. 6.6 g of S-75 polyamine (a commercially available blend of tetraethylene pentamine, pentaethylene hexamine and other higher ethylene polyamines) was then added dropwise over a period of about 30 minutes. The reaction mixture was held at 160° C. for 4 hours and then allowed to cool to room temperature. 100 g of the succinimide product was then charged to a reaction vessel, and 100 g of "SHELLSOL" (trade mark) A solvent (ex. Shell Additives International Limited) added together with various levels of PMDA. The mixture was stirred under a nitrogen blanket and heated to approximately 180° C. and held at this temperature for 4 hours. The "SHELLSOL" A solvent was then removed by rotary evaporation at 120° C. and 10 mbar vacuum for 2 hours. A measure of the dispersant characteristics was then carried out using the Haake rheology test as described above. The results are shown in Table 1.

TABLE 1

Rheology Data HMW/PMDA compounds

| Post-reaction rate, % w/w PMDA | Viscosity at ~0.26 $s^{-1}$ shear rate, Pa.s |
|---|---|
| 0 | 12.4 |
| 1.0 | 7.2 |
| 1.1 | 5.0 |
| 1.2 | 0.4 |
| 1.3 | 0.6 |
| 1.5 | 0.7 |
| 1.7 | 4.5 |
| 1.8 | 6.0 |
| 2.0 | 8.7 |
| 5.0 | 15.3 |

The peak of performance was found to be at a treat-rate of 1.2% w/w.

EXAMPLE 2

Preparation of LMW/PMDA Dispersant

A reaction vessel was charged with 200 g polyisobutyenyl succinic anhydride (76% active matter in HVI-60 and an acid value of 1.66 mmol/g, comprising the reaction product of polyisobutene of Mn 950 and maleic anhydride) and then heated to 160° C. under a nitrogen blanket. 27.39 g of TEPA (tetraethylene pentamine) was then added dropwise over a period of about 30 minutes. The reaction was held at 160° C. for 4 hours and then allowed to cool to room temperature. 100 g of the succinimide product was then charged to a reaction vessel and 100 g of "SHELLSOL" A solvent was added together with various amounts of PMDA. The mixture was stirred under a nitrogen blanket, heated to approximately 180° C. and held at this temperature for 4 hours. Residual "SHELLSOL" A was removed by rotary evaporation at 120° C. and 100 mbar vacuum for 2 hours. A Haake rheology test was carried out as described previously. The results are shown in Table 2.

TABLE 2

Rheology Data LMW/PMDA compounds

| Post-reaction rate, % w/w PMDA | Viscosity at ~0.26 $s^{-1}$ shear rate, Pa.s |
|---|---|
| 0 | 7.2 |
| 1.5 | 2.0 |
| 2.5 | 0.17 |
| 3.0 | 0.23 |
| 3.5 | 0.7 |
| 4.0 | 1.9 |
| 4.5 | 5.3 |
| 5.0 | 17.4 |

The peak of performance was found to be at the 2.5% w/w treat-rate.

EXAMPLE 3

Preparation of LMW/PMDA Dispersant

The same procedure as Example 2 above was used, except that 20.54 g TEPA was used for the preparation of the succinimide. The post-reaction with PMDA was carried out in the same manner as Example 2. A Haake rheology test was carried out as described previously, and the results are shown in Table 3.

TABLE 3

Rheology Data LMW/PMDA compounds

| Post-reaction rate, % w/w PMDA | Viscosity at ~0.26 $s^{-1}$ shear rate, Pa.s |
|---|---|
| 0 | 11.8 |
| 0.5 | 7.4 |
| 1.0 | 3.2 |

TABLE 3-continued

| Rheology Data LMW/PMDA compounds | |
|---|---|
| Post-reaction rate, % w/w PMDA | Viscosity at ~0.26 $s^{-1}$ shear rate, Pa.s |
| 2.0 | 8.3 |
| 3.0 | 18.4 |

The peak of performance was found to be at the 1.0% w/w treat-rate.

In each case the results show surprising improvements over dispersants in the prior art. For example, the results in Table 1 for the 1.2% w/w PMDA-treated compound show a significant improvement over the corresponding high molecular weight compound disclosed in Example 3 of EP-A-0331397, where post-treatment was 2% w/w. The value for the 1.2% w/w PMDA treated compound was 0.4 Pa.s compared to 9 Pa.s for the EP-A-0331397 compound.

What is claimed is:

1. An oil-soluble, post-treated dispersant obtained by reacting:

(A) the reaction product of a polyamine of formula (I):

$$H_2N—(CHR^1)_x—CH_2—(A—CH_2—(CHR^1)_2)_y—NH_2 \quad (I)$$

wherein A is NH or O; each $R^1$ is H or methyl; x is 1–6; and y is 1–10 when A is NH, or 1 to 200 when A is O; and a long-chain hydrocarbyl-substituted dicarboxylic acid, anhydride or ester thereof, which is a reaction product of a polyolefin and a $C_4$–$C_{10}$ dicarboxylic acid, anhydride or ester; with (B) a polyanhydride;

characterised in that the post-treated dispersant provides a reduced viscosity increase in a sooted oil relative to a corresponding, non-post-treated dispersant.

2. An oil-soluble dispersant according to claim 1, wherein less than 3%w/w polyanhydride is reacted.

3. An oil-soluble dispersant according to claim 2, wherein less than 2% w/w polyanhydride is reacted.

4. An oil-soluble dispersant according to claim 1, wherein the polyanhydride is pyromellitic dianhydride.

5. An oil-soluble dispersant according to claim 1, wherein the polyamine is tetraethylene pentamine, or a mixture thereof with pentaethylene hexamine and other higher ethylene polyamines.

6. An oil-soluble dispersant additive according to claim 1, wherein the polyolefin has a molecular weight from 700 to 5000.

7. An oil-soluble dispersant according to claim 1, wherein the molar ratio of dicarboxylic acid, anhydride or ester: polyolefin is from 1:1 to 2:1.

8. An oil-soluble dispersant according to claim 1 wherein the polyolefin is polyisobutylene or atactic polypropylene.

9. A lubricating oil composition comprising a major amount of a lubricating base oil and a minor amount of a dispersant according to claim 1.

10. An additive concentrate comprising an inert carrier fluid and from 10 to 80 wt. % of a dispersant according to claim 1.

* * * * *